US012163743B2

(12) United States Patent
Asai

(10) Patent No.: US 12,163,743 B2
(45) Date of Patent: Dec. 10, 2024

(54) HEAT EXCHANGER, REFRIGERATION CYCLE APPARATUS, METHOD OF MANUFACTURING CORRUGATED FIN, AND MANUFACTURING APPARATUS FOR MANUFACTURING CORRUGATED FIN

(71) Applicant: Mitsubishi Electric Corporation, Tokyo (JP)

(72) Inventor: Yuto Asai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 270 days.

(21) Appl. No.: 17/761,316

(22) PCT Filed: Oct. 29, 2020

(86) PCT No.: PCT/JP2020/040573
§ 371 (c)(1),
(2) Date: Mar. 17, 2022

(87) PCT Pub. No.: WO2021/095538
PCT Pub. Date: May 20, 2021

(65) Prior Publication Data

US 2022/0341682 A1 Oct. 27, 2022

(30) Foreign Application Priority Data

Nov. 11, 2019 (JP) ..... 2019-203800

(51) Int. Cl.
*B21D 13/04* (2006.01)
*B21D 53/02* (2006.01)
(Continued)

(52) U.S. Cl.
CPC ..... *F28F 1/30* (2013.01); *B21D 53/022* (2013.01); *F28F 1/02* (2013.01); *F28F 17/005* (2013.01); *F28F 2215/08* (2013.01)

(58) Field of Classification Search
CPC .... F28F 1/30; F28F 1/02; F28F 17/005; F28F 2215/08; F28F 1/128; B21D 53/022; B21D 11/08; B21D 13/04; F28D 1/05366
See application file for complete search history.

(56) References Cited

FOREIGN PATENT DOCUMENTS

CN 101050930 A * 10/2007 ..... F28F 1/128
EP 1229296 A1 * 8/2002 ..... B21D 53/085
(Continued)

OTHER PUBLICATIONS

English translation of CN-101050930-A (Year: 2007).*
(Continued)

*Primary Examiner* — Jun S Yoo
(74) *Attorney, Agent, or Firm* — BUCHANAN, INGERSOLL & ROONEY PC

(57) ABSTRACT

A heat exchanger includes a plurality of flat heat transfer tubes each having a flat cross-sectional shape, a flat outer side surface, and an interior defining a passage through which a fluid flows, the plurality of flat heat transfer tubes being arranged with the flat outer side surfaces facing each other, and a plurality of corrugated fins each having a wavy shape, each of the plurality of corrugated fins being disposed between and joined to flat heat transfer tubes of the plurality of flat heat transfer tubes that are adjacent to each other. Each of the plurality of corrugated fins has portions that correspond to peaks of the wavy shape and have lower flexural rigidity than other portions of the corrugated fin.

9 Claims, 14 Drawing Sheets

(51) Int. Cl.

| | |
|---|---|
| ***F28F 1/02*** | (2006.01) |
| ***F28F 1/30*** | (2006.01) |
| ***F28F 17/00*** | (2006.01) |

(56) References Cited

FOREIGN PATENT DOCUMENTS

| | | | | | |
|---|---|---|---|---|---|
| EP | 3015808 | A1 | | 5/2016 | |
| JP | S5666688 | U | | 6/1981 | |
| JP | H05106986 | A | | 4/1993 | |
| JP | H07060369 | A | | 3/1995 | |
| JP | 11147149 | A | * | 6/1999 | ..... F28F 1/128 |
| JP | H11148793 | A | | 6/1999 | |
| JP | 11309564 | A | * | 11/1999 | ..... B23K 1/0012 |
| JP | 2001050678 | A | | 2/2001 | |
| JP | 2014114979 | A | | 6/2014 | |
| WO | 2014207785 | A1 | | 12/2014 | |

OTHER PUBLICATIONS

English translation of JP-11147149-A (Year: 1999).*
English translation of JP-11309564-A (Year: 1999).*
International Search Report (PCT/ISA/210), with translation, and Written Opinion (PCT/ISA/237) mailed on Dec. 1, 2020, by the Japan Patent Office as the International Searching Authority for International Application No. PCT/JP2020/040573.

* cited by examiner

HEAT EXCHANGER, REFRIGERATION CYCLE APPARATUS, METHOD OF MANUFACTURING CORRUGATED FIN, AND MANUFACTURING APPARATUS FOR MANUFACTURING CORRUGATED FIN

TECHNICAL FIELD

The present disclosure relates to a heat exchanger, a refrigeration cycle apparatus, a method of manufacturing a corrugated fin, and a manufacturing apparatus for manufacturing a corrugated fin, and in particular, relates to the precision of processing corrugated fins.

BACKGROUND ART

Heat exchangers incorporated in, for example, air-conditioning and cooling apparatuses, refrigeration apparatuses, and radiators, include a developed, flat-tube heat exchanger. To save refrigerant and achieve higher performance, the flat-tube heat exchanger includes multi-hole flat heat transfer tubes, through which the refrigerant flows, instead of cylindrical tubes.

Some heat exchangers include a plurality of flat heat transfer tubes arranged in a direction orthogonal to an air passage direction, corrugated fins each disposed in a depth direction between two adjacent flat heat transfer tubes and meandering upward, and a plurality of louvers arranged horizontally in the corrugated fins (refer to Patent Literature 1, for example).

CITATION LIST

Patent Literature

Patent Literature 1: Japanese Unexamined Patent Application Publication No. 07-060369

SUMMARY OF INVENTION

Technical Problem

A method of manufacturing a corrugated fin includes a roller forming step as described in Patent Literature 1. The roller forming step includes corrugating a sheet material into a wavy shape with gear-shaped roller dies and cutting the sheet material to form cuts for, for example, louvers, in the sheet material.

In the roller forming step, the sheet material, which is to be a corrugated fin, is affected by, for example, the amount of oil applied to the dies and a change in tension due to, for example, bending in the corrugating. For example, the pitch of the peaks of the wavy shape may be varied, so that the precision of processing may decrease. In particular, if the sheet material has, for example, drain holes through which water on the fin is discharged, the wavy shape formed in the roller forming step, the cuts, and the drain holes may be displaced from each other.

To solve the above problem, it is an object of the present disclosure to provide a heat exchanger including corrugated fins processed with high precision, a refrigeration cycle apparatus, a method of manufacturing a corrugated fin, and a manufacturing apparatus for manufacturing a corrugated fin.

Solution to Problem

An embodiment of the present disclosure provides a heat exchanger including a plurality of flat heat transfer tubes each having a flat cross-sectional shape, a flat outer side surface, and an interior defining a passage through which a fluid flows, the plurality of flat heat transfer tubes being arranged with the flat outer side surfaces facing each other, and a plurality of corrugated fins each having a wavy shape, each of the plurality of corrugated fins being disposed between and joined to flat heat transfer tubes of the plurality of flat heat transfer tubes that are adjacent to each other. Each of the plurality of corrugated fins has portions that correspond to peaks of the wavy shape and have lower flexural rigidity than other portions of the corrugated fin.

Another embodiment of the present disclosure provides a refrigeration cycle apparatus including the above-described heat exchanger.

Another embodiment of the present disclosure provides a method of manufacturing a corrugated fin for a heat exchanger, the corrugated fin being wave-shaped, the method including steps of preprocessing a sheet material to be the corrugated fin to cause portions of the sheet material to have lower flexural rigidity than other portions of the corrugated fin, and corrugating the sheet material into a wavy shape by bending the portions having lower flexural rigidity.

Advantageous Effects of Invention

According to an embodiment of the present disclosure, the corrugated fins of the heat exchanger include the portions having different flexural rigidities. The heat exchanger includes the corrugated fins each including easy-to-bend portions, which correspond to the peaks of the wavy shape and have lower flexural rigidity. Thus, the heat exchanger including the corrugated fins having, for example, a highly accurate pitch of the peaks of the wavy shape is provided.

DESCRIPTION OF EMBODIMENTS

Embodiments of the present disclosure will be described below with reference to the drawings. Note that components designated by the same reference signs in the following figures are the same components or equivalents. This note applies to the entire description of the embodiments described below. Furthermore, note that the forms of components described herein are intended to be illustrative only and the forms of the components are not intended to be limited to those described herein. In particular, combinations of the components are not intended to be limited only to those in the embodiments. A component in one embodiment is usable in another embodiment as appropriate. Various changes, alterations, and modifications are possible without departing from technical ideas of the present disclosure described in the claims. For a plurality of devices of the same type that are, for example, distinguished from each other using letters, if the devices do not have to be distinguished from each other or specified, the letters may be omitted.

Embodiment 1

Figure 1:
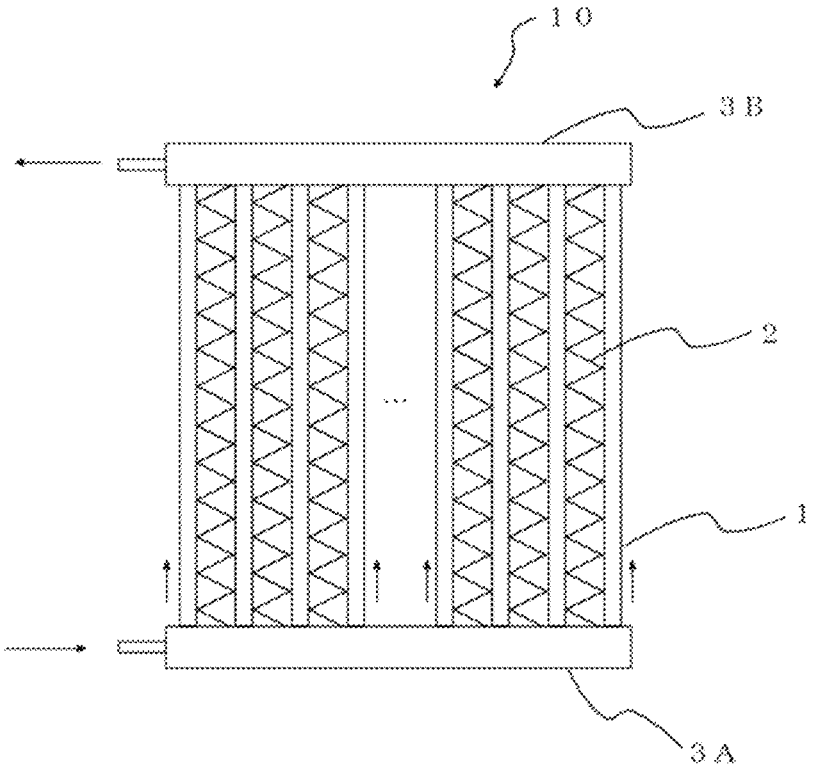
FIG. 1 is a diagram illustrating the configuration of a heat exchanger according to Embodiment 1.

FIG. 1 is a diagram illustrating the configuration of a heat exchanger according to Embodiment 1. As illustrated in FIG. 1, a heat exchanger 10 according to Embodiment 1 is a parallel-tube type corrugated-fin-and-tube heat exchanger. The heat exchanger 10 includes a plurality of multi-hole flat heat transfer tubes 1, a plurality of corrugated fins 2, and a pair of headers 3 (i.e., a header 3A and a header 3B).

The headers 3 are connected to external devices by pipes. Each header 3 is a pipe into or out of which refrigerant, which is a fluid as a heat exchange medium, flows and through which the refrigerant is divided into streams or through which the refrigerant streams join together. The plurality of multi-hole flat heat transfer tubes 1 are arranged parallel to each other between the two headers 3 such that the tubes are perpendicular to each header 3. As illustrated in FIG. 1, the heat exchanger 10 according to Embodiment 1 includes the two headers 3 arranged vertically or separately at upper and lower positions. The header 3A through which liquid refrigerant passes is located at the lower position. The header 3B through which gas refrigerant passes is located at the upper position.

Figure 2:
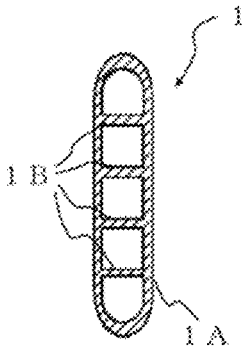
FIG. 2 is a diagram illustrating an internal configuration of a multi-hole flat heat transfer tube in Embodiment 1.

As illustrated in FIG. 2, which will be described later, the multi-hole flat heat transfer tubes 1 are flat heat transfer tubes each having a flat cross-sectional shape, flat outer side surfaces in a longitudinal direction of the flat cross-sectional shape in which air flows, and curved outer side surfaces in a lateral direction orthogonal to the longitudinal direction. Each multi-hole flat heat transfer tube 1 has an interior provided with a plurality of holes, serving as refrigerant passages. In Embodiment 1, the holes of the multi-hole flat heat transfer tube 1 extend vertically and thus serve as passages between the headers 3. The multi-hole flat heat transfer tubes 1 are arranged horizontally at regular intervals such that the outer side surfaces in the longitudinal direction face each other. As will be described later, the multi-hole flat heat transfer tubes 1 are brazed and joined to the headers 3 with a brazing material. The multi-hole flat heat transfer tubes 1 will be described in detail later.

While the heat exchanger 10 is used as a condenser, high-temperature and high-pressure refrigerant flows through the refrigerant passages in the multi-hole flat heat transfer tubes 1. While the heat exchanger 10 is used as an evaporator, low-temperature and low-pressure refrigerant flows through the refrigerant passages in the multi-hole flat heat transfer tubes 1. The refrigerant flows into one of the headers 3 from an external device (not illustrated) through a pipe (not illustrated) through which the refrigerant is supplied to the heat exchanger 10. The refrigerant having flowed into the one header 3 is distributed to the multi-hole flat heat transfer tubes 1 such that streams of the refrigerant flow through the tubes. The multi-hole flat heat transfer tubes 1 allow the refrigerant flowing inside the tubes and outdoor air, which is the atmosphere, flowing outside the tubes to exchange heat with each other. At this time, the refrigerant transfers heat to or removes heat from the atmosphere while flowing through the multi-hole flat heat transfer tubes 1. When the refrigerant has a higher temperature than the temperature of the outside air, the refrigerant transfers its own heat to the outdoor air. When the refrigerant has a lower temperature than the temperature of the outdoor air, the refrigerant removes heat from the atmosphere. The streams of the refrigerant subjected to heat exchange through the multi-hole flat heat transfer tubes 1 flow into the other header 3 and join together. Then, the refrigerant flows to an external device (not illustrated) through a pipe (not illustrated) connected to the other header 3.

The corrugated fins 2 are arranged between the arranged multi-hole flat heat transfer tubes 1. The corrugated fins 2 are fins arranged to increase the area of heat transfer between the refrigerant and the outdoor air. The corrugated fins 2, which each have a zigzag wavy shape, are formed by fan-folding a sheet material into alternating ridges and grooves. The wavy shape defines ridges. In Embodiment 1, the ridges of the corrugated fins 2 are arranged vertically. The flat surfaces of the multi-hole flat heat transfer tubes 1 are in surface contact with the peaks of the ridges of the wavy shape of the corrugated fins 2. Contact portions are brazed and joined together with a brazing material. The corrugated fins 2 will be described in detail later.

FIG. 2 is a diagram illustrating an internal configuration of the multi-hole flat heat transfer tube in Embodiment 1. The multi-hole flat heat transfer tube 1 is a tube formed by extruding an aluminum alloy, for example. The multi-hole flat heat transfer tube 1 includes a flat outer tube 1A and one or more internal partitions 1B dividing the interior of the outer tube into two or more passages. The outer tube 1A and the internal partitions 1B are made of the same material. In the multi-hole flat heat transfer tube 1, the outer tube 1A has a lateral dimension of from 1 to 5 mm. Furthermore, the outer tube 1A has a longitudinal dimension of from 10 to 40 mm. The outer tube 1A and the internal partitions 1B preferably each have a thickness of 0.2 mm or more from the viewpoint of resistance to pressure and corrosion. The outer tube 1A and the internal partitions 1B have a uniform thickness, and the number of internal partitions 1B is the same at any position.

In manufacturing the heat exchanger 10 according to Embodiment 1, the multi-hole flat heat transfer tubes 1 are inserted into and brazed to insertion holes (not illustrated) of the headers 3. For a brazing material, for example, a brazing material containing aluminum is used. For a method of brazing, brazing is performed with the brazing material heated by, for example, a burner, high frequency induction heating, or an electric furnace. Any method of heating the brazing material is usable as long as brazing is achieved. Feeding the brazing material is achieved by, for example, manually-fed brazing or preplaced brazing. The brazing material is usable in the form of, for example, brazing wire, brazing paste, cladding material, or brazing foil. A clearance between each insertion hole in the headers 3 and the corresponding multi-hole flat heat transfer tube 1 needs to ensure the ease of insertion and brazing of the multi-hole flat heat transfer tube 1. The clearance therefore often ranges from approximately 0.1 to approximately 0.4 mm.

Figure 3:
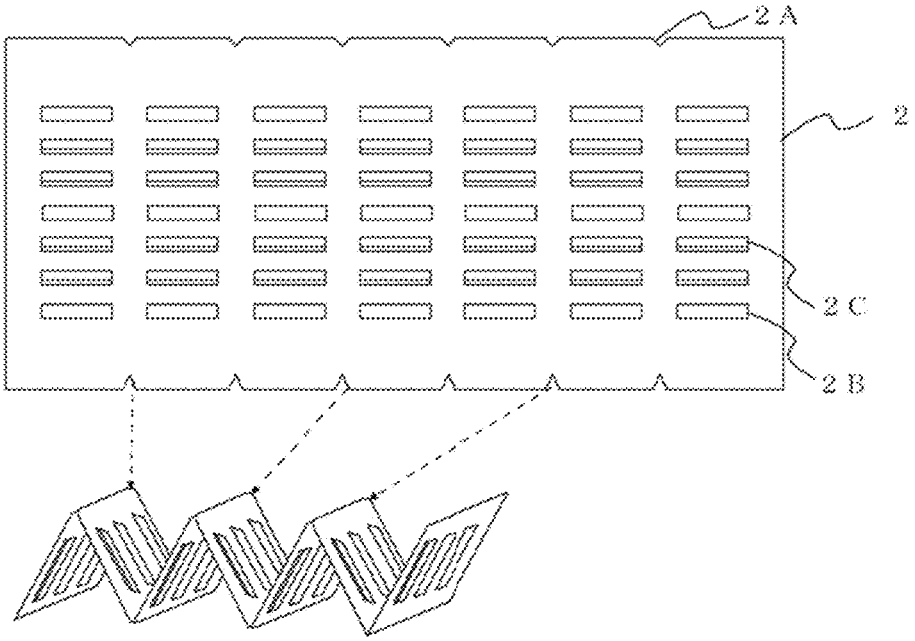
FIG. 3 is a diagram explaining a corrugated fin for the heat exchanger according to Embodiment 1.

A sheet material for the corrugated fin 2 is made of, for example, an aluminum alloy. The sheet material has a surface covered with a brazing cladding. The brazing cladding is basically made of a brazing material containing aluminum, such as an aluminum-silicon brazing material. The sheet material has a thickness of from approximately 50 to approximately 200 μm. In the heat exchanger 10 according to Embodiment 1, as illustrated in FIG. 3, which will be described later, the corrugated fins 2 have drain holes 2B through which condensate water generated, for example, on the fins is drained. The drain holes 2B may have any shape, such as a square shape and a rectangular shape. The length of one side of each drain hole 2B is preferably 0.7 mm or more.

FIG. 3 is a diagram explaining the corrugated fin for the heat exchanger according to Embodiment 1. FIG. 3 illustrates a sheet material for the corrugated fin 2, and the sheet material is not corrugated. As illustrated in FIG. 3, the corrugated fin 2 included in the heat exchanger 10 according to Embodiment 1 has notches 2A, the drain holes 2B, and louvers 2C. The louvers 2C are portions at which the flow of air passing through the fin is changed. The louvers 2C each have a slit, which is a through-hole through which the air passes, and a slat that guides the air passing through the slit. The louvers 2C are formed by cutting and raising the slats. The drain holes 2B are through-holes through which condensate water on the fin is discharged. The corrugated fin 2 in Embodiment 1 has the notches 2A at positions corresponding to the peaks of the ridges. In Embodiment 1, the notches 2A arranged at the positions corresponding to the peaks of the wavy shape have reduced flexural rigidity in portions of the sheet material. In corrugating the sheet material into a wavy shape, the portions having reduced flexural rigidity, which are easy-to-bend portions, serve as references at which the peeks are positioned when the ridges and the grooves are formed. In manufacturing the corrugated fin 2 in Embodiment 1, the sheet material is therefore preprocessed to provide the notches 2A in the sheet material. Thus, the portions having reduced flexural rigidity are intentionally formed.

Figure 4:
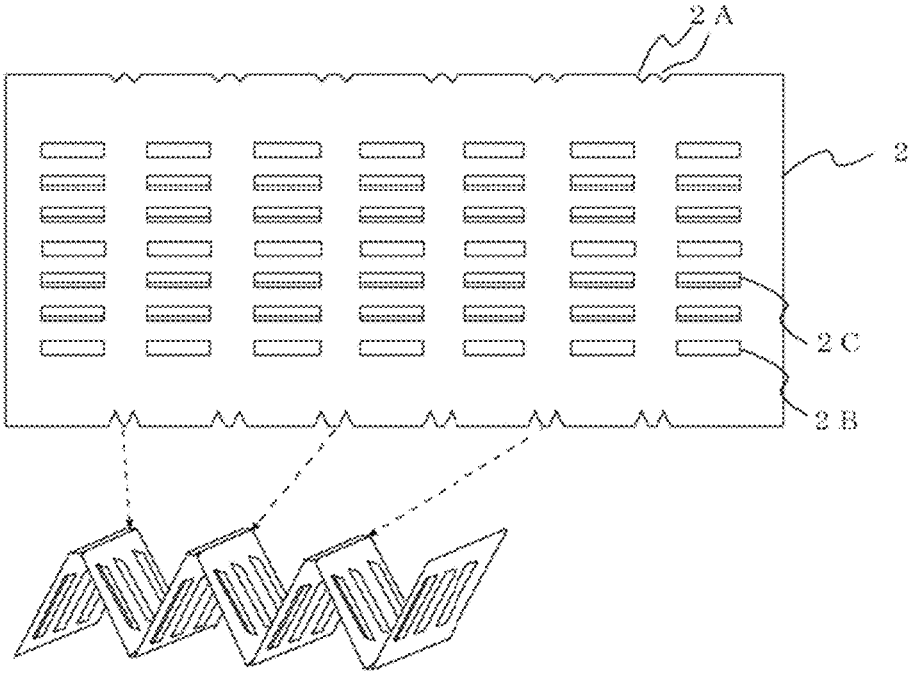
FIG. 4 is a diagram explaining another exemplary corrugated fin for the heat exchanger according to Embodiment 1.
Figure 5A:
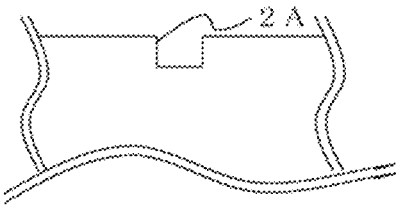
FIGS. 5(*a*)-5(*d*) are diagrams illustrating exemplary notches for corrugated fins in Embodiment 1.
Figure 5B:
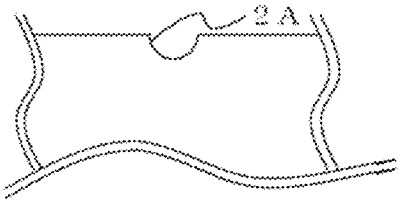
Figure 5C:
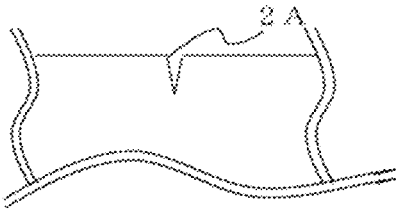
Figure 5D:
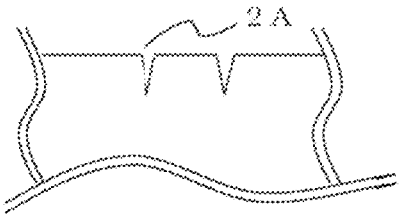
Figure 6A:
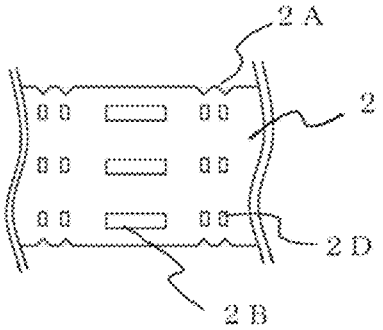
FIGS. 6(*a*)-6(*d*) are diagrams explaining preprocessing for the corrugated fins in Embodiment 1.
Figure 6B:
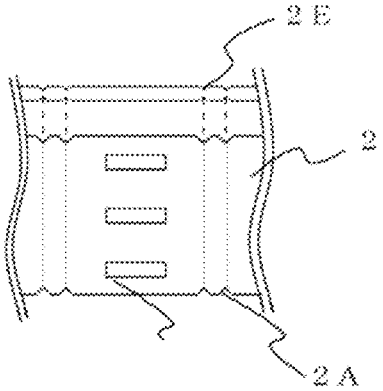
Figure 6C:
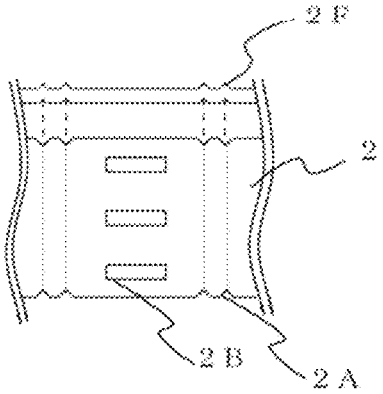
Figure 6D:
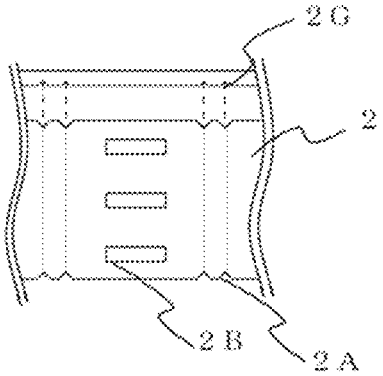

FIG. 4 is a diagram explaining another exemplary corrugated fin for the heat exchanger according to Embodiment 1. For example, as illustrated in FIG. 4, the corrugated fin 2 is allowed to have two notches 2A for each ridge to provide a flat portion at the peak of the ridge. Also in this corrugated fin 2, portions with reduced flexural rigidity are allowed to be intentionally formed, and similar advantages are thus provided.

FIG. 5 includes diagrams illustrating exemplary notches for the corrugated fins in Embodiment 1. FIG. 5(*a*) illustrates a rectangular notch 2A. FIG. 5(*b*) illustrates a semicircular notch 2A. FIG. 5(*c*) illustrates a triangular notch 2A. FIG. 5(*d*) illustrates a plurality of notches 2A. Although FIG. 5 illustrates four types of notches 2A, the notch 2A may have any shape or any number of notches 2A may be provided as long as the notches have reduced rigidity of portions to be bent. For example, the notch 2A may be shaped in consideration of drainage performance and heat transfer performance.

FIG. 6 includes diagrams explaining preprocessing for the corrugated fins in Embodiment 1. As described above, the heat exchanger 10 according to Embodiment 1 includes the corrugated fins 2 having the notches 2A. For this reason, the sheet material is preprocessed to provide the notches 2A in the sheet material. Preprocessing is allowed to involve not only providing the notches 2A but also a variety of processing for combination with the notches 2A.

For example, FIG. 6(*a*) illustrates a preprocessed sheet material having the notches 2A and through-holes 2D. FIG. 6(*b*) illustrates a preprocessed sheet material having the notches 2A and cut grooves 2E each having a depth substantially equal to half the thickness of the sheet material. FIG. 6(*c*) illustrates a preprocessed sheet material having the notches 2A and including easy-to-bend parts 2F, which are made easy to bend by bending the sheet material. FIG. 6(*d*) illustrates a preprocessed sheet material having the notches 2A and a plurality of dents 2G. Any of the above-described features is allowed to have further reduced flexural rigidity of the sheet material in combination with the notches 2A. Although FIG. 6 illustrates four types of processing in addition to providing the notches 2A in the preprocessing, any other processing may be performed. Processing for combination of any features of FIGS. 6(*a*) to 6(*d*) may be performed.

As described above, in the heat exchanger 10 according to Embodiment 1, the corrugated fins 2 have the notches 2A at the positions corresponding to the peaks of the wavy shape so that the flexural rigidity in portions with the notches 2A differs from that in other portions. The portions with the notches 2A thus have lower flexural rigidity than the other portions, so that the portions with the notches 2A are easy to bend. As the notches 2A are provided at the positions corresponding to the peaks of the wavy shape in advance, the peaks of the wavy shape are allowed to be formed with high precision at intended positions in the corrugating. In addition, cuts are allowed to be formed at intended positions with high precision also in the cutting.

The notches 2A of the corrugated fins 2 in the heat exchanger 10 according to Embodiment 1 are provided by preprocessing. In particular, in a case in which the corrugated fins 2 have the drain holes 2B, a punching step of providing the drain holes 2B and a preprocessing step are performed, and relative displacement of the wavy shape, the cuts for, for example, the louvers 2C, and the drain holes 2B is thus prevented.

If a sheet material having a high material tensile strength is preprocessed to provide only the through-holes 2D for positioning in addition to the notches 2A as illustrated in FIG. 6(*a*) described above, the holes may be deformed, and the effect of positioning by the through-holes 2D is thus reduced.

Figure 7A:
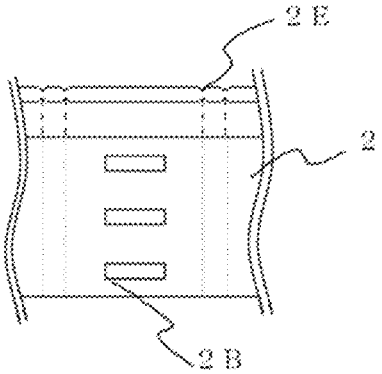
FIGS. 7(*a*)-7(*c*) are diagrams explaining other examples of preprocessing for the corrugated fins in the heat exchanger according to Embodiment 1.
Figure 7B:
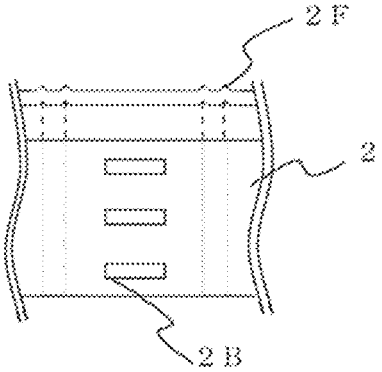
Figure 7C:
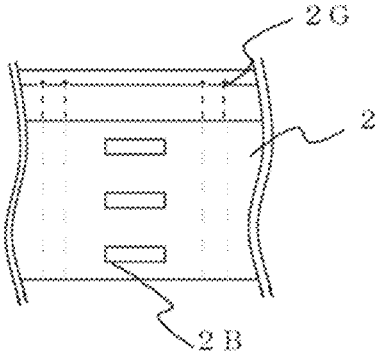

FIG. 7 includes diagrams explaining other examples of preprocessing for the corrugated fins in the heat exchanger according to Embodiment 1. The above-described corrugated fins 2 have the notches 2A, so that the flexural rigidity in the portions with the notches 2A is made different from that in the other portions. FIG. 7 illustrates preprocessing for providing features other than the notches 2A that make a difference in flexural rigidity. FIG. 7(*a*) illustrates a sheet material having the cut grooves 2E, illustrated in FIG. 6, to make a difference in flexural rigidity. FIG. 7(*b*) illustrates a sheet material including the easy-to-bend parts 2F, illustrated in FIG. 6, to make a difference in flexural rigidity. FIG. 7(*c*) illustrates a sheet material having the dents 2G, illustrated in FIG. 6, to make a difference in flexural rigidity.

In the sheet materials for the corrugated fins 2 of FIG. 7, the effect of reducing the flexural rigidity at intended positions is achieved without the notches 2A. It is therefore unnecessary to remove cutouts that are left in providing the notches 2A. Such absence of cutouts eliminates problems such as the abrasion of dies, a breakdown, and an equipment failure, which are caused by cutouts caught in the dies or the equipment in processing the sheet materials to manufacture the corrugated fins 2.

Figure 8:
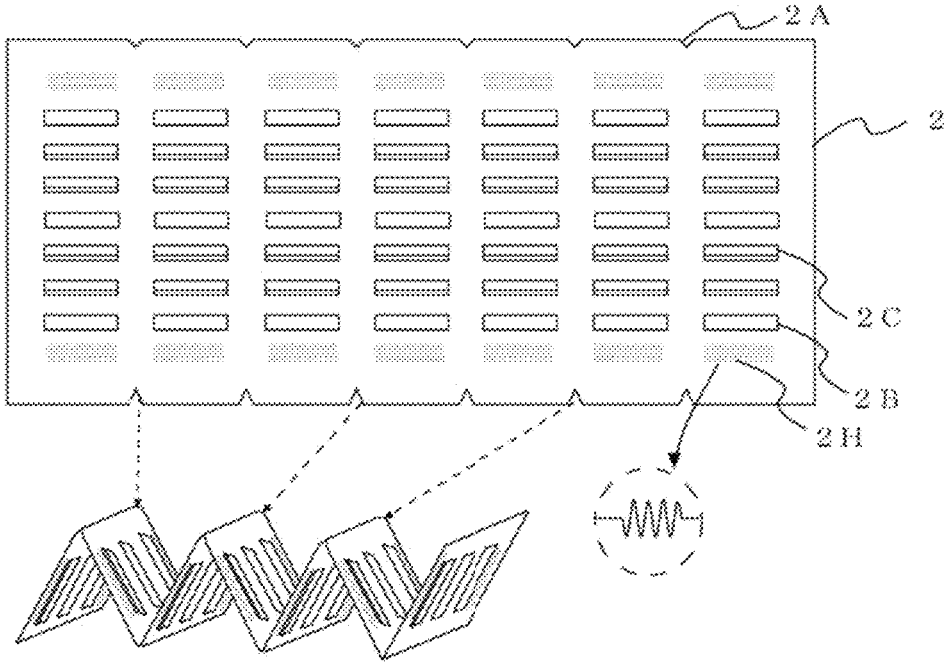
FIG. 8 is a diagram explaining another example of preprocessing for the corrugated fins in the heat exchanger according to Embodiment 1.

FIG. 8 is a diagram explaining another example of preprocessing for the corrugated fins in the heat exchanger according to Embodiment 1. As illustrated in FIG. 8, the corrugated fin 2 may have zigzag corrugations 2H extending orthogonally to the peaks of the ridges of the wavy shape, which is formed in a bending direction in which the sheet material is bent or corrugated. The corrugations 2H are located in sides, other than the peaks, of the ridges of the corrugated fin 2 and are parallel to the drain holes 2B, for example. The corrugations 2H extend in the longitudinal direction of the sheet material. The corrugations 2H are therefore arranged in a direction in which the wavy shape extends.

The corrugations 2H formed in preprocessing for the corrugated fin 2 cause the flexural rigidity of the sheet material to be higher than usual in the bending direction in corrugating the sheet material into a wavy shape. In the corrugating, the direction in which the sheet material is bent is the direction in which the peaks of the ridges are arranged. This manner increases the difference in flexural rigidity between portions with the notches 2A that have reduced flexural rigidity and correspond to the peaks and portions with the corrugations 2H, so that the portions having lower flexural rigidity and the portions having higher flexural rigidity are thus distinguished from each other. This distinction further enhances the precision of bending at intended positions in the corrugating.

The portions with the corrugations 2H have a larger surface area than other portions with no corrugations 2H. This structure increases the area of regions that receive, at the sides of the ridges of the corrugated fin 2, air that passes through the corrugated fin 2. The corrugations 2H of the corrugated fin 2 therefore contribute, not only during processing but also after processing, to improvement of the performance of the heat exchanger.

The corrugated fins 2 having, for example, the cut grooves 2E, the easy-to-bend parts 2F, or the dents 2G described above, are allowed to have the corrugations 2H. The corrugations 2H are allowed to be formed in addition to, for example, the notches 2A, the cut grooves 2E, the easy-to-bend parts 2F, or the dents 2G, by preprocessing.

Although FIG. 8 illustrates the corrugated fin 2 having the notches 2A and the corrugations 2H, the corrugated fin 2 may have only the corrugations 2H. Such absence of notches 2A eliminates cutouts that are left in providing the notches 2A, and, for example, problems such as the abrasion of dies and a breakdown caused by cutouts caught in the dies or the corrugated fin are thus prevented. In addition, as compared with preprocessing at portions to be bent, preprocessing for the corrugations enhances, for example, the rigidity and strength of the heat exchanger subjected to brazing.

Embodiment 2

In Embodiment 2, a method of manufacturing a heat exchanger, particularly, the corrugated fin 2 in Embodiment 1, will be mainly described. The following description will focus on the method of manufacturing a heat exchanger 10 including the corrugated fins 2. The multi-hole flat heat transfer tubes 1 and the corrugated fins 2 are alternately arranged to form a row of corrugated fins such that each corrugate fin 2 is sandwiched between the multi-hole flat heat transfer tubes 1. Then, in a compressing step, the multi-hole flat heat transfer tubes 1 and the corrugated fins 2 are compressed in a direction in which the tubes and the fins are arranged. Thus, the multi-hole flat heat transfer tubes 1 come into close contact with the peaks of the ridges of the corrugated fins 2, so that the multi-hole flat heat transfer tubes 1 are brought into surface contact with the peaks of the ridges of the corrugated fins 2. This compressing step causes the spacing between the multi-hole flat heat transfer tubes 1 to be maintained constant and coincide with the spacing between the insertion holes (not illustrated), into which the multi-hole flat heat transfer tubes 1 are inserted, of the headers 3. The multi-hole flat heat transfer tubes 1 are inserted into the insertion holes of the headers 3, so that the tubes are retained in the insertion holes even when the compression is released. Thus, the shape of the heat exchanger 10 is kept even before a brazing step. The row of corrugated fins is formed in the above-described manner. Subsequently, the brazing step is performed to braze the multi-hole flat heat transfer tubes 1, the corrugated fins 2, and the headers 3 to each other so that the heat exchanger 10 is thus manufactured.

Figure 9A:
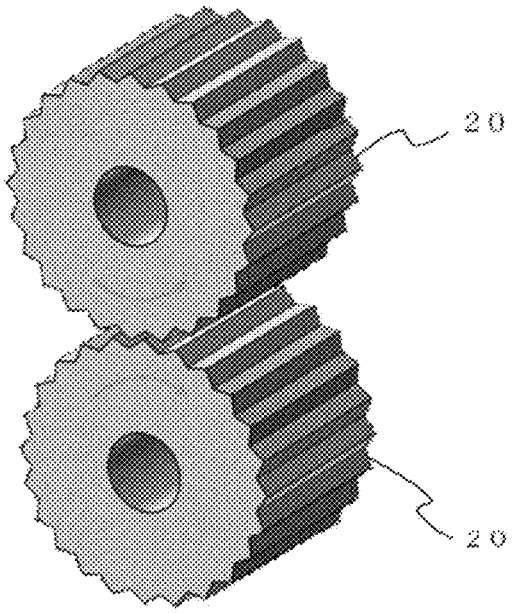
FIGS. 9(*a*) and 9(*b*) are diagrams explaining a corrugated fin manufacture method according to Embodiment 2.
Figure 9B:
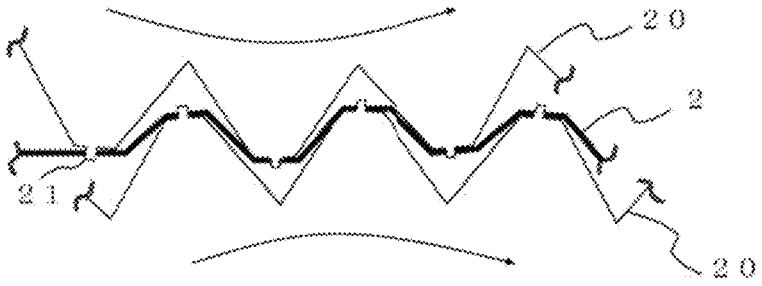

FIG. 9 includes diagrams explaining the method of manufacturing the corrugated fin in Embodiment 2. The method of manufacturing the corrugated fin 2 described in Embodiment 1 will be described in more detail below. The corrugated fin 2 is manufactured by roller forming. Such a roller forming step involves cutting a sheet material to form cuts for the louvers 2C in the sheet material and corrugating the sheet material into a wavy shape. The corrugating is performed with gear-shaped roller dies 20 with teeth having a triangular cross-section as illustrated in FIG. 9(*a*). In the roller forming step, as long as processing conditions, such as a variation in thickness of the sheet material, processing tension, processing speed, and the amount of oil applied to the dies, are in good agreement with optimum possible values, the positions of the drain holes 2B provided in the punching step will exactly coincide with their positions in the corrugating.

In the heat exchanger 10 according to Embodiment 1, portions of the sheet material that have lower flexural rigidity correspond to the peaks of the wavy shape of the corrugated fin 2. Embodiment 2 provides higher accuracy positioning of portions with lower flexural rigidity. In Embodiment 2, as illustrated in FIG. 9(*b*), the teeth, in other words, the ridges of the roller dies 20 have protrusions 21 for positioning.

Figure 10A:
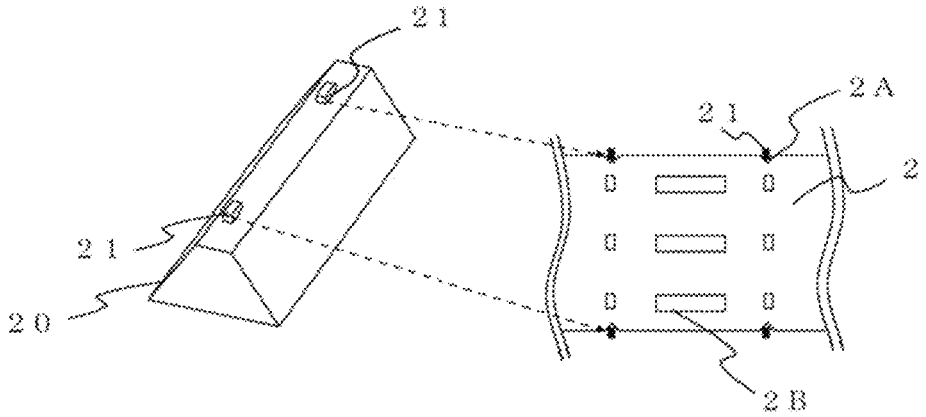
FIGS. 10(*a*) and 10(*b*) are diagrams explaining teeth of roller dies in Embodiment 2.
Figure 10B:
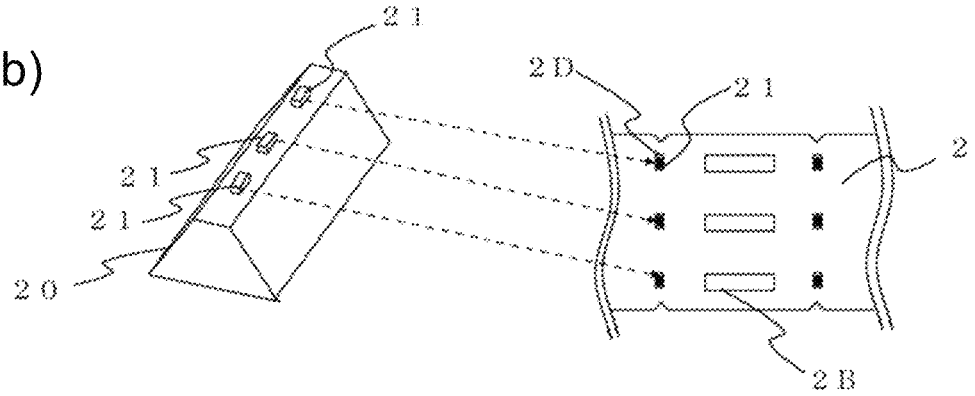
Figure 11A:
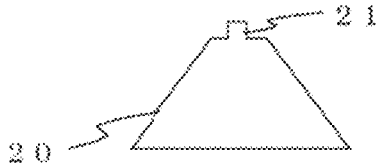
FIGS. 11(*a*)-11(*d*) are diagrams illustrating the shapes of protrusions of the roller dies in Embodiment 2.
Figure 11B:
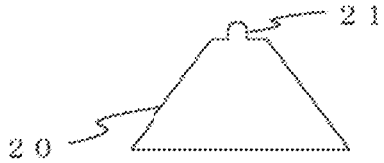
Figure 11C:
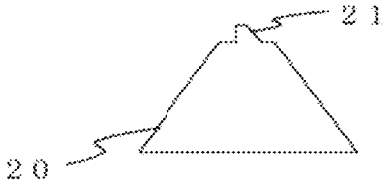
Figure 11D:
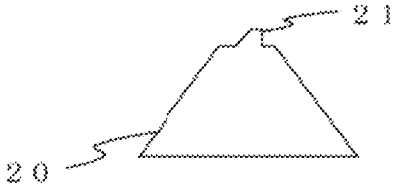

FIG. 10 includes diagrams explaining the teeth of the roller die in Embodiment 2. In the corrugating, as illustrated in FIG. 10(*a*), the protrusions 21 are caught by the notches 2A, which are described above in Embodiment 1 and are intended to have reduced rigidity so that the sheet material is thus positioned on the roller dies 20. In a case in which the through-holes 2D are arranged in addition to the notches 2A, as illustrated in FIG. 10(*b*), the protrusions 21 may be inserted into and caught by the through-holes 2D so that the sheet material, which is to be the corrugated fin 2, is positioned on the roller dies 20. For measures to facilitate release of the protrusions 21 from the sheet material, for example, an angle at which the protrusions 21 enter or leave the through-holes 2D is reduced by reducing the height of the protrusions 21 or increasing the diameter of such gears.

In the corrugating, the sheet material is bent at the portions catching the protrusions 21, and the ridges are thus formed. The protrusions 21 preferably have a height equal to the sum of the thickness of the sheet material and an amount of from approximately 0.2 to approximately 0.5 mm. For the size of the protrusions 21, the protrusions 21 have a size smaller than that of the notches 2A or the through-holes 2D by an amount of from approximately 0.01 to approximately 0.2 mm. As the size of the protrusions 21 is thus reduced, play between the protrusions 21 and the notches 2A or play between the protrusions 21 and the through-holes 2D is reduced, and precise corrugating is thus achieved.

FIG. 11 includes diagrams illustrating the shapes of protrusions of the roller dies in Embodiment 2. FIG. 11(*a*) illustrates a protrusion 21 having sharp edges. FIG. 11(*b*) illustrates a protrusion 21 whose edges are beveled by slight-chamfering or rounding the edges such that the radius R of curvature of each edge is 0.1 or more. FIGS. 11(*c*) and 11(*d*) each illustrate a protrusion 21 having edges having different angles or different radii of curvature formed by, for example, heavily chamfering one of the edges of the tooth.

Figure 12A:
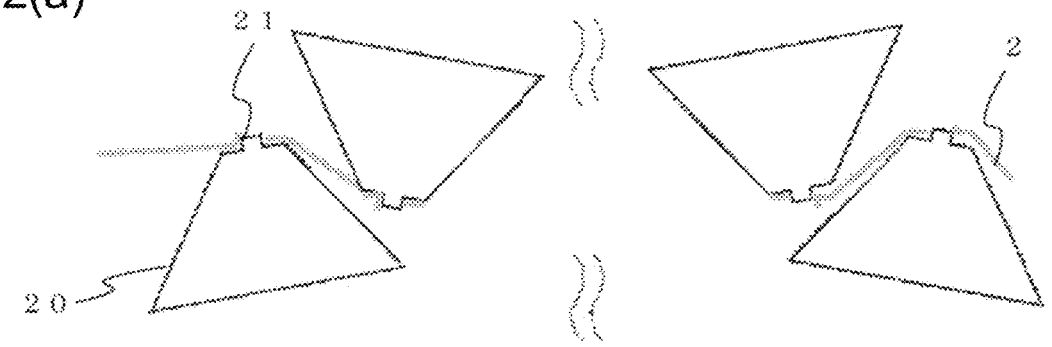
FIGS. 12(*a*) and 12(*b*) are diagrams explaining the difference between the manners in which protrusions are released from a sheet material in Embodiment 2.
Figure 12B:
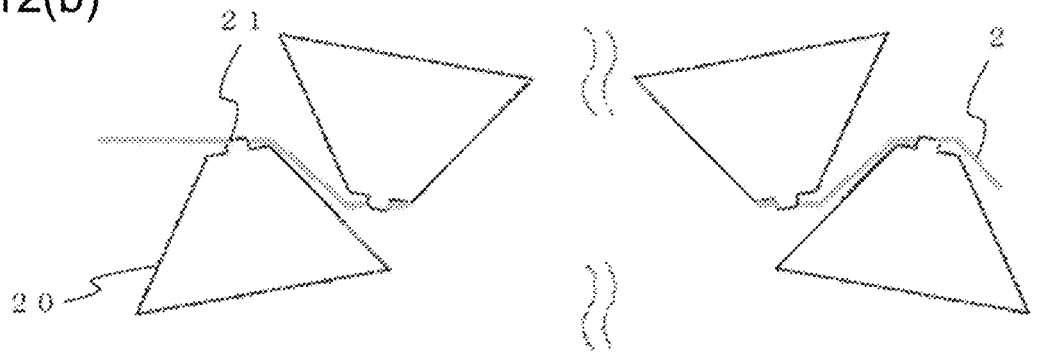

FIG. 12 includes diagrams explaining the difference between the manners in which the protrusions are released from the sheet material in Embodiment 2. For example, if the teeth have sharp edges like the protrusion 21 illustrated in FIG. 11(*a*), the edges may hinder the protrusions 21 from being successfully caught by the sheet material as illustrated in FIG. 12(*a*). In addition, the protrusions 21 may fail to be released from the sheet material. In Embodiment 2, like the protrusion 21 illustrated in FIG. 11(*b*), the edges of the teeth are beveled by, for example, slight-chamfering. The beveled edges of the protrusions 21 allow the protrusions 21 to be smoothly caught and released in the corrugating as illustrated in FIG. 12(*b*). Furthermore, heavily chamfering one edge of each protrusion 21, as illustrated in FIGS. 11(*c*) and 11(*d*), facilitates release of the protrusion from the sheet material, which is to be the corrugated fin 2. After the sheet material is corrugated into the corrugated fin 2, the angle of each ridge and the pitch distance between the ridges are adjusted by, for example, compressing the corrugated fin 2.

Figure 13A:
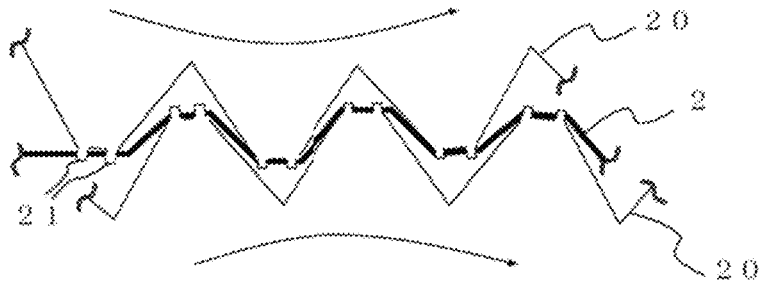
FIGS. 13(*a*)-13(*c*) are diagrams explaining another exemplary manufacture of a corrugated fin for a heat exchanger in Embodiment 2.
Figure 13B:
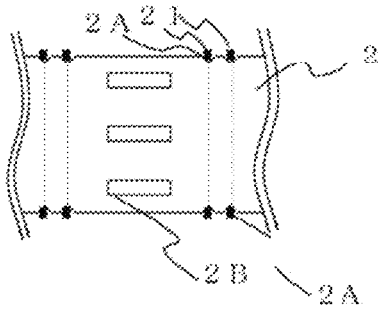
Figure 13C:
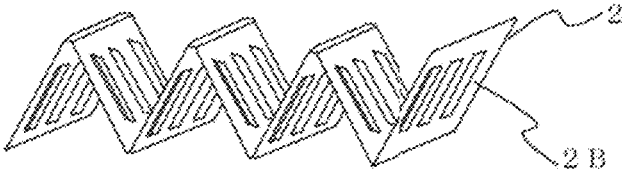

FIG. 13 includes diagrams explaining another exemplary manufacture of a corrugated fin for a heat exchanger in Embodiment 2. FIG. 5(*d*) described above illustrates the plurality of notches 2A for reducing the flexural rigidity. FIG. 13 illustrates the protrusions 21 arranged on the ridges of the roller dies 20 and associated with the notches 2A. In the corrugating, as illustrated in FIGS. 13(*a*) and 13(*b*), the protrusions 21 are caught by the notches 2A, which are portions with reduced flexural rigidity, at two positions for each wave, and the sheet material is then bent. This manner allows the ridges of the corrugated fin 2 to have sharper edges. The sharper edges of the ridges of the corrugated fin 2 form flat peaks of the ridges as illustrated in FIG. 13(*c*), so that the area of flat portions increases. This structure increases the degree of close contact between the corrugated fin 2 and the multi-hole flat heat transfer tubes 1 and the area of brazing between the corrugated fin 2 and the multi-hole flat heat transfer tubes 1, and improved performance is thus achieved. The above-described positioning at two positions achieves higher dimensional precision of the corrugated fin 2, and assembly productivity is thus improved.

Figure 14A:
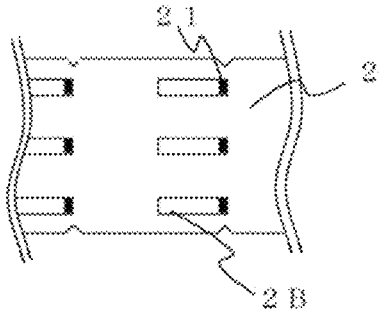
FIGS. 14(*a*) and 14(*b*) are diagrams explaining other examples of positioning in corrugating for a heat exchanger in Embodiment 2.
Figure 14B:
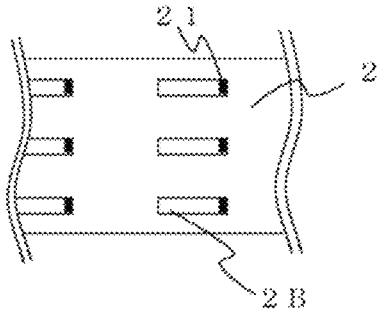

FIG. 14 includes diagrams explaining other examples of positioning in the corrugating for the heat exchanger in Embodiment 2. For example, as illustrated in FIG. 14(*a*), the drain holes 2B provided in the punching step may be used to make positioning in such a manner that the protrusions 21 are inserted into the drain holes 2B. For example, in a case of conditions unfavorable for punching, in which, for example, if the through-holes 2D for positioning are opened, the spacing between the through-holes may become significantly narrower, corrugating is achieved without increasing the number of through-holes 2D or opening the through-holes 2D.

In this case, as illustrated in FIG. 14(*b*), the notches 2A provided by preprocessing may be omitted. For example, the omission of the notches 2A and the through-holes 2D increases the area of contact between the multi-hole flat heat transfer tubes 1 and the peaks of the ridges of the corrugated fins 2. This manner increases the area of brazing, and heat exchange performance is thus improved. The omission of the notches 2A and the through-holes 2D reduces the likelihood of lack of a brazing material caused by penetration of the brazing material into space defined by the notches 2A and the through-holes 2D. The amount of brazing material used to manufacture the heat exchanger is thus reduced. Thus, the heat exchanger is manufactured economically.

Although the protrusions 21 are arranged on the tips of the teeth of the roller dies 20, the protrusions may be arranged at other positions. For example, the protrusions arranged on the sloping sides of the teeth provide a similar positioning effect.

As described above, for the heat exchanger 10 in Embodiment 2, the teeth of the roller dies 20 for corrugating have the protrusions 21. The protrusions 21 are caught by the notches 2A, provided by preprocessing, or are inserted into the through-holes 2D so that the sheet material is thus positioned. The heat exchanger 10 is thus manufactured that includes the corrugated fins 2 having the drain holes 2B, previously provided in the sheet materials in the punching step, positioned with the ridges with high accuracy.

Embodiment 3

Figure 15A:
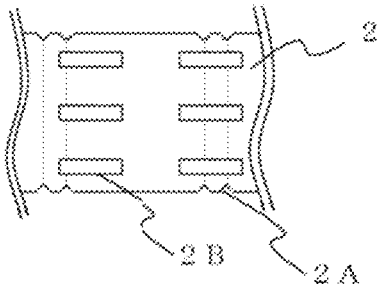
FIGS. 15(*a*) and 15(*b*) are diagrams explaining the positions of drain holes in corrugated fins according to Embodiment 3.
Figure 15B:
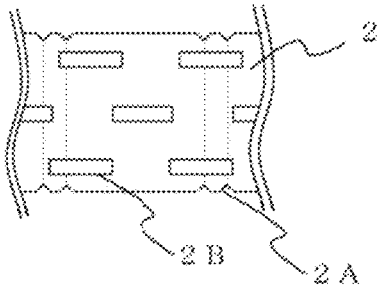

FIG. 15 includes diagrams explaining the positions of drain holes in corrugated fins according to Embodiment 3. For example, FIG. 15(*a*) illustrates a corrugated fin 2 having the drain holes 2B whose positions are periodically shifted in a corrugating direction. The drain holes 2B are therefore arranged at different positions in the vertical direction in which the corrugated fins 2 extend when installed. FIG. 15(*b*) illustrates a corrugated fin 2 having the drain holes 2B arranged in a pseudo-random pattern. The drain holes 2B are therefore arranged at different positions in an air passage direction.

Figure 16A:
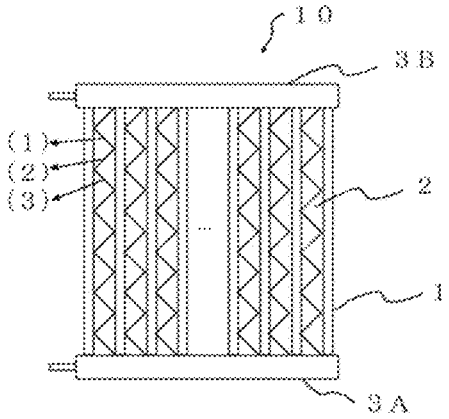
FIGS. 16(*a*)-16(*c*) are diagrams explaining drainage of the corrugated fins according to Embodiment 3.
Figure 16B:
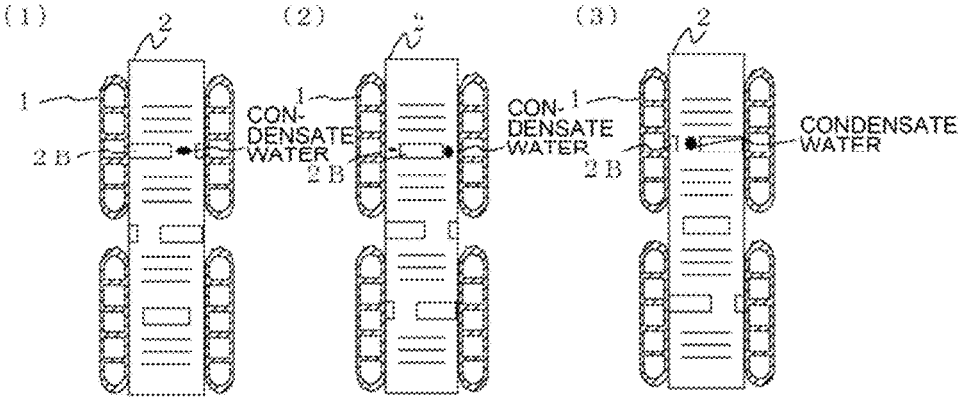
Figure 16C:
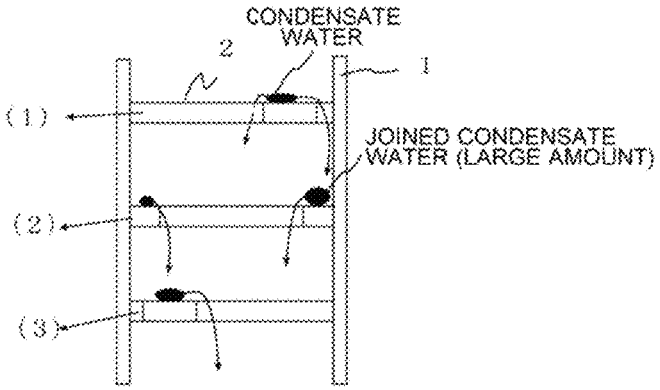

FIG. 16 includes diagrams explaining drainage of the corrugated fins according to Embodiment 3. The following description will focus on drainage of condensate water on the corrugated fins 2 having the drain holes 2B illustrated in FIG. 15(*b*).

FIG. 16(*b*) illustrates three portions (1), (2), and (3) of the corrugated fin 2 in FIG. 16(*a*). As illustrated in FIG. 16(*b*), the drain holes 2B in the three portions (1), (2), and (3) of the corrugated fin 2 are arranged at different positions in the vertical direction. In this arrangement, some of the drain holes 2B are not vertically aligned with each other such that the openings of the drain holes 2B are not successively positioned. As illustrated in FIG. 16(*c*), condensate water therefore falls from an upper portion of the fin and joins with condensate water on a lower portion of the fin, so that the amount of water increases. Thus, the condensate water easily flows downward. A heat exchanger 10 in Embodiment 3 including the corrugated fins 2 having the drain holes 2B arranged at different positions thus has improved drainage performance.

Embodiment 4

In Embodiment 2 described above, roller forming is described as an exemplary manner to manufacture the corrugated fins 2. Furthermore, the corrugated fins may be shaped in any other manner. For example, if pressing is used to manufacture the corrugated fins 2, positioning is achieved by using, for example, the notches 2A and the through-holes 2D described in Embodiment 2.

In Embodiment 2, the order of the punching step of providing the drain holes 2B for the corrugated fins 2 and the preprocessing of reducing the flexural rigidity is not particularly described above. For example, the preprocessing may be performed simultaneously with the punching step of providing the drain holes 2B. Furthermore, the preprocessing may be performed in a step separate from the punching step.

In Embodiment 2 described above, the multi-hole flat heat transfer tubes 1 and the corrugated fins 2 are alternately arranged and compressed, the tubes are inserted into the headers 3, and these components are brazed together so that the heat exchanger 10 is thus manufactured. The procedure is not limited to this example. The multi-hole flat heat transfer tubes 1 and the corrugated fins 2 may be brazed together and then attached to the headers 3. Furthermore, the structure of each header 3 is not limited to a single-piece structure. For example, the header 3 is divided into pieces to set the flow of the refrigerant in the heat exchanger 10.

In Embodiment 1, the multi-hole flat heat transfer tubes 1 are described above as exemplary heat transfer tubes. Furthermore, any other tubes may be used as long as the tubes serve as heat transfer tubes. For example, tubes that do not include the internal partitions 1B and have a single passage inside the tubes may be used. Furthermore, the heat transfer tubes may have any cross-sectional shape.

In Embodiment 1 describe above, the headers 3 and the multi-hole flat heat transfer tubes 1 are made of a metal material containing aluminum. The material is not limited to this example. A material for the headers 3 and the multi-hole flat heat transfer tubes 1 is selectable depending on the purpose of using the heat exchanger 10, the environment of an installation place, or the properties of the heat exchange medium. Furthermore, any type of brazing material is usable. A brazing material only has to be selected with which each of the material for the headers 3 and the material for the multi-hole flat heat transfer tubes 1 is well soldered.

The concrete shape and structure of the corrugated fins 2, the material for the corrugated fins, and the manners to process the corrugated fins described in Embodiments 1 and 2 are merely examples and are not intended to be limited. In particular, the notches 2A and the through-holes 2D provided by preprocessing for positioning may have any shape other than these examples.

In addition, the concrete shapes and structures of the multi-hole flat heat transfer tubes 1 and the headers 3, the material for the tubes and the headers, and the manners to process the tubes and the headers described in Embodiment 1 are merely examples. In particular, the number of internal partitions 1B included in each multi-hole flat heat transfer tube 1 and the shape of the internal partition 1B are not limited to these examples. In addition, for example, the concrete shape and structure of the heat exchanger 10 and the orientation of the heat exchanger 10 installed in a device illustrated in Embodiment 1 are merely examples.

The applications of the heat exchanger 10 described in Embodiment 1 are not particularly limited. For example, the heat exchanger 10 may be used as an evaporator or a condenser. Furthermore, the heat exchanger 10 may be used as a cooler or a heater.

The orientation of the heat exchanger 10 illustrated in Embodiment 2 during brazing and that in actual installation are not particularly limited. For example, a surface facing upward during brazing may face downward or be held in a landscape or portrait orientation in installation.

Embodiment 5

Figure 17:
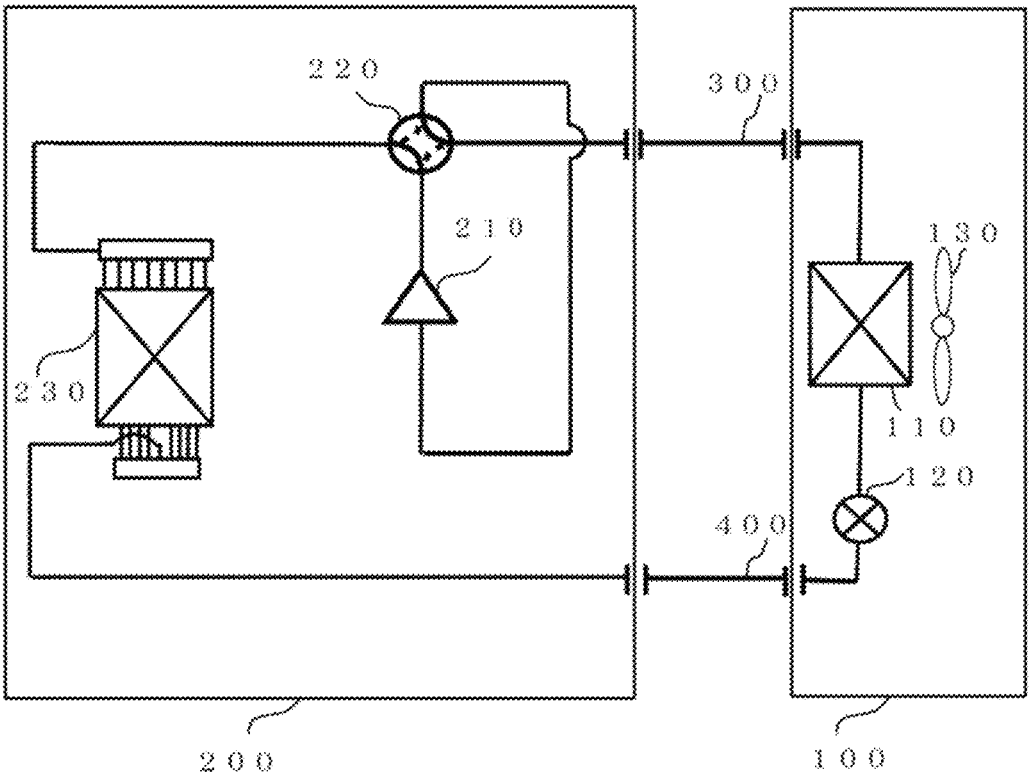
FIG. 17 is a diagram illustrating the configuration of an air-conditioning apparatus according to Embodiment 5.

FIG. 17 is a diagram illustrating the configuration of an air-conditioning apparatus according to Embodiment 5. In Embodiment 5, the air-conditioning apparatus will be described as an example of a refrigeration cycle apparatus. The air-conditioning apparatus in Embodiment 5 includes the heat exchanger 10 described in Embodiments 1 to 4 as an outdoor heat exchanger 230.

As illustrated in FIG. 17, the air-conditioning apparatus includes an outdoor unit 200 and an indoor unit 100, which are connected by a gas refrigerant pipe 300 and a liquid refrigerant pipe 400 to form a refrigerant circuit. The outdoor unit 200 includes a compressor 210, a four-way valve 220, and the outdoor heat exchanger 230. A case will be described in which the air-conditioning apparatus according to Embodiment 5 includes a single outdoor unit 200 and a single indoor unit 100 connected by pipes.

The compressor 210 sucks, compresses, and discharges the refrigerant. The compressor 210 is, but not particularly limited to, a compressor whose capacity is variable by changing its operating frequency to any value through, for example, an inverter circuit. The four-way valve 220 is a valve that switches between, for example, a refrigerant flow direction for a cooling operation and that for a heating operation.

The outdoor heat exchanger 230 allows the refrigerant and the outdoor air to exchange heat with each other. For example, in the heating operation, the outdoor heat exchanger 230 operates as an evaporator to evaporate and gasify the refrigerant. In the cooling operation, the outdoor heat exchanger 230 operates as a condenser to condense and liquefy the refrigerant.

The indoor unit 100 includes the indoor heat exchanger 110, an expansion valve 120, and an indoor fan 130. The expansion valve 120, which is, for example, an expansion device, reduces the pressure of the refrigerant to expand the refrigerant. In a case in which the expansion valve 120 is, for example, an electronic expansion valve, its opening degree is adjusted in accordance with an instruction from, for example, a controller (not illustrated). The indoor heat exchanger 110 allows the refrigerant and the air in a room, which is an air-conditioned space to exchange heat with each other. For example, in the heating operation, the indoor heat exchanger 110 operates as a condenser to condense and liquefy the refrigerant. In the cooling operation, the indoor heat exchanger 110 operates as an evaporator to evaporate and gasify the refrigerant. The indoor fan 130 causes the air in the room to pass through the indoor heat exchanger 110, and supplies the air passing through the indoor heat exchanger 110 to the room.

As described above, the air-conditioning apparatus according to Embodiment 5 includes, as the outdoor heat exchanger 230, the heat exchanger 10 described in Embodiments 1 to 4. The outdoor heat exchanger 230 manufactured by highly precise processing delivers improved heat exchange performance and increased operating efficiency of the air-conditioning apparatus.

REFERENCE SIGNS LIST

1: multi-hole flat heat transfer tube, 1A: outer tube, 1B: internal partition, 2: corrugated fin, 2A: notch, 2B: drain hole, 2C: louver, 2D: through-hole, 2E: cut groove, 2F: easy-to-bend part, 2G: dent, 2H: corrugations, 3, 3A, 3B: header, 10: heat exchanger, 20: roller die, 21: protrusion, 100: indoor unit, 110: indoor heat exchanger, 120: expansion valve, 130: indoor fan, 200: outdoor unit, 210: compressor, 220: four-way valve, 230: outdoor heat exchanger, 300: gas refrigerant pipe, 400: liquid refrigerant pipe

The invention claimed is:

1. A method of manufacturing a corrugated fin for a heat exchanger, the corrugated fin having a wavy shape, the method comprising:

preprocessing a sheet material to be the corrugated fin to cause portions of the sheet material to have lower flexural rigidity than other portions of the corrugated fin by providing through-holes;

positioning the sheet material on a roller that is gear-shaped and configured to form the sheet material into the wavy shape and has a tooth provided with a protrusion in such a manner that the protrusion is caught by the through-hole in the corrugating; and corrugating the sheet material into the wavy shape by bending the portions having lower flexural and rigidity.

2. The method of manufacturing a corrugated fin of claim 1, further comprising:

causing two portions of one wave to each have one of the portions having lower flexural rigidity, and forming a flat peak of the wavy shape.

3. The method of manufacturing a corrugated fin of claim 1, wherein the protrusion has a chamfered or rounded edge.

4. The method of manufacturing a corrugated fin of claim 3, wherein the protrusion has the chamfered or rounded edges having different angles or different radii of curvature.

5. The method of manufacturing a corrugated fin of claim 1, further comprising:

forming a cut groove at positions at which the portions having lower flexural rigidity are to be located.

6. The method of manufacturing a corrugated fin of claim 1, further comprising:

forming an easy-to-bend part at positions at which the portions having lower flexural rigidity are to be located.

7. The method of manufacturing a corrugated fin of claim 1, further comprising:

forming a dent at positions at which the portions having lower flexural rigidity are to be located.

8. The method of manufacturing a corrugated fin of claim 1, further comprising:

bending portions excluding the portions having lower flexural rigidity to form corrugations having a zigzag shape extending in a direction in which the wavy shape extends.

9. The method of manufacturing a corrugated fin of claim 1, further comprising:

providing a notch at positions at which the portions having lower flexural rigidity in the preprocessing are to be located; and positioning the sheet material on the roller in such a manner that the protrusion is caught by at least one of the through-hole and the notch in the corrugating.

* * * * *